US007413446B1

(12) United States Patent
Jilg et al.

(10) Patent No.: US 7,413,446 B1
(45) Date of Patent: Aug. 19, 2008

(54) ELECTRICAL CONNECTOR MODULE

(75) Inventors: Daniel James Jilg, Novi, MI (US); Max A. Gatsche, Jr., Flat Rock, MI (US); Laura Diane Wakeford, Commerce Township, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/803,584

(22) Filed: May 14, 2007

(51) Int. Cl.
*H01R 12/00* (2006.01)

(52) U.S. Cl. ..... 439/76.1

(58) Field of Classification Search ..... 439/76.1, 439/79, 692, 903, 701
See application file for complete search history.

(56) References Cited

U.S. PATENT DOCUMENTS 5,108,300 A * 4/1992 Weber ..... 439/188
5,703,346 A 12/1997 Bricaud et al. ..... 235/44.1
6,005,241 A 12/1999 Doty et al. ..... 250/222.1
6,010,363 A 1/2000 Dobrich et al. ..... 439/571
6,034,876 A * 3/2000 Ohno et al. ..... 361/752
6,129,561 A 10/2000 Lok ..... 439/76.1
6,276,943 B1 8/2001 Boutros et al. ..... 439/76.1
6,309,225 B2 * 10/2001 Kameyama ..... 439/76.1
6,634,888 B2 * 10/2003 Villain ..... 439/22
6,773,270 B2 * 8/2004 Ushio et al. ..... 439/76.1
6,796,806 B2 9/2004 Boutros et al. ..... 439/76.1
7,144,258 B2 * 12/2006 Ariga et al. ..... 439/76.1

* cited by examiner

*Primary Examiner*—Tho D Ta
(74) *Attorney, Agent, or Firm*—Harrington & Smith, PC

(57) ABSTRACT

An electrical connector module including a plurality of electrical contact terminals; and a frame adapted to be attached to a housing. The electrical contact terminals are connected to the frame and have opposite ends which extend away from the frame in two respective different directions. The frame includes a plug section adapted to be mechanically plugged into the housing and a resiliently deflectable snap finger adapted to snap-lock behind a portion of the housing.

18 Claims, 4 Drawing Sheets

ELECTRICAL CONNECTOR MODULE

BACKGROUND OF THE INVENTION

1. Field of the Invention

The invention relates to an electrical connector and, more particularly, to a module having electrical contact terminals.

2. Brief Description of Prior Developments

U.S. Pat. No. 6,129,561 discloses a plug connector securing a printed circuit board with contacts. U.S. Pat. No. 6,010,363 discloses a connector assembly with a dove-tail mounting structure. There is a desire to provide a modular type of electrical connector module which can be connected to a housing to provide a configurable assembly for manufacturing an electronic device adapted to be connected to an electrical connector.

SUMMARY OF THE INVENTION

In accordance with one aspect of the invention, an electrical connector module is provided including a plurality of electrical contact terminals; and a frame adapted to be attached to a housing. The electrical contact terminals are connected to the frame and have opposite ends which extend away from the frame in two respective different directions. The frame includes a plug section adapted to be mechanically plugged into the housing and a resiliently deflectable snap finger adapted to snap-lock behind a portion of the housing.

In accordance with another aspect of the invention, an electrical connector module is provided comprising a plurality of electrical contact terminals; and a frame having the electrical contact terminals mounted thereto. The frame comprises a housing mounting section adapted to mount the frame to a housing. The housing mounting section comprises angled rail sections on opposite sides of the frame and a snap finger at a rear end of the frame. The rail sections are adapted to slide into a general dove-tail receiving slot of the housing. The snap finger is adapted to snap behind a portion of the housing and exert a continuous force against the portion of the housing.

In accordance with another aspect of the invention, an electrical connector module is provided comprising a carrier frame adapted to be mounted to a receiving housing and a plurality of electrical contact terminals. The carrier frame comprises a general L shaped cross section with a first leg and a second leg. The plurality of electrical contact terminals are mounted to the carrier frame. The electrical contact terminals each comprise a general L shape with a first leg mounted in the first leg of the carrier frame and a second leg extending in a direction generally opposite to the second leg of the carrier frame. The second leg of the carrier frame is adapted to be snapped into the receiving housing.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
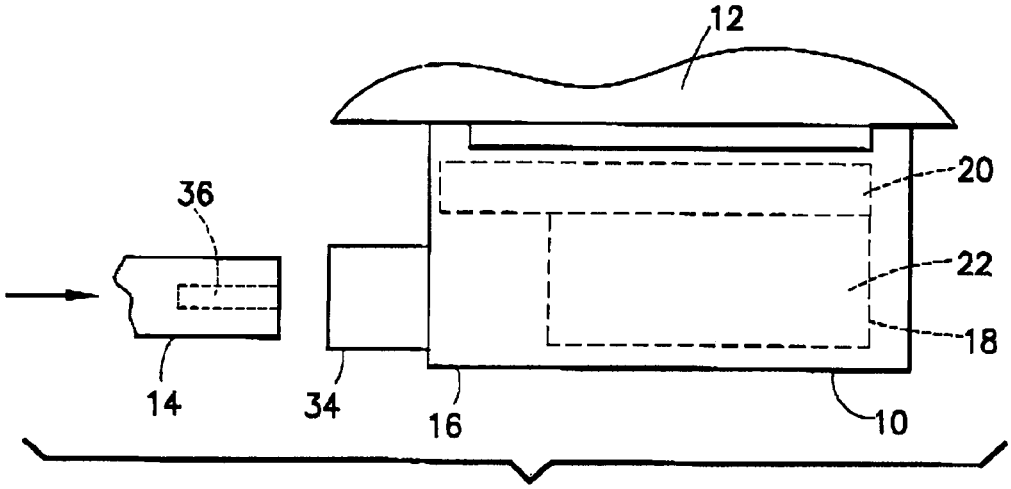
FIG. 1 is a side view of a device comprising features of the invention shown attached to another member.

Referring to FIG. 1, there is shown a side view of an electrical or electronic device 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

The device 10 is an inertia sensor. However, features of the invention could be used in any suitable type of electronic or electrical device, or could be used in any suitable type of electrical connector. The device 10 is shown attached to another member 12 and is adapted to sense movement of the member 12. The device 10 is adapted to be connected to a mating electrical connector 14 for transmitting signals from the device 10 to another device (not shown). The device 10 generally comprises a housing assembly 16 and at least one electronic component 18. In the embodiment shown, electronic component 18 can comprise, for example, a printed circuit board (PCB) 20 and a sensor 22 mounted to the PCB. However, any suitable electrical or electronic component(s) could be provided. The housing assembly 16 houses the electronic component(s).

Figure 2:
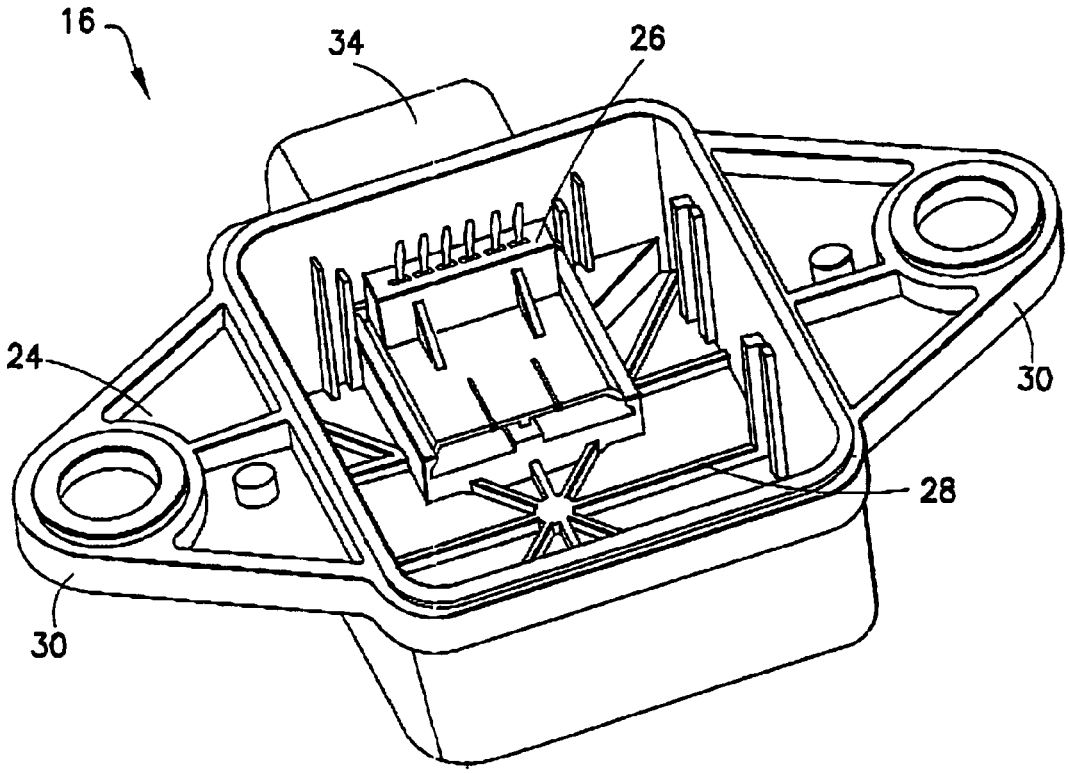
FIG. 2 is a perspective view of a housing assembly of the device shown in FIG. 1.
Figure 3:
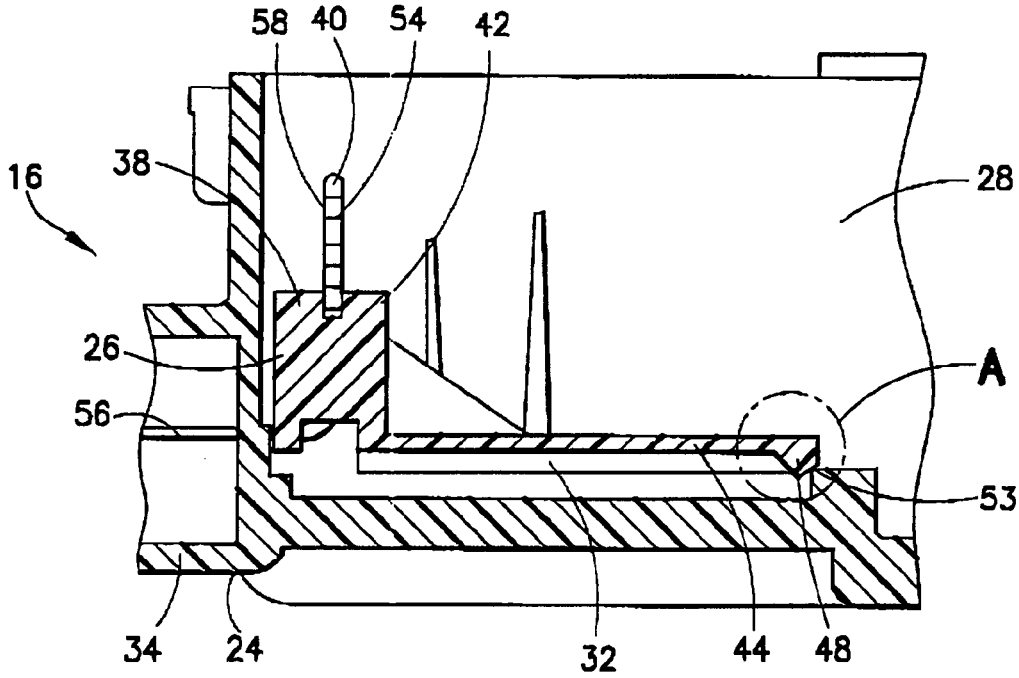
FIG. 3 is a cross sectional view of a portion of the assembly shown in FIG. 2.
Figure 4:
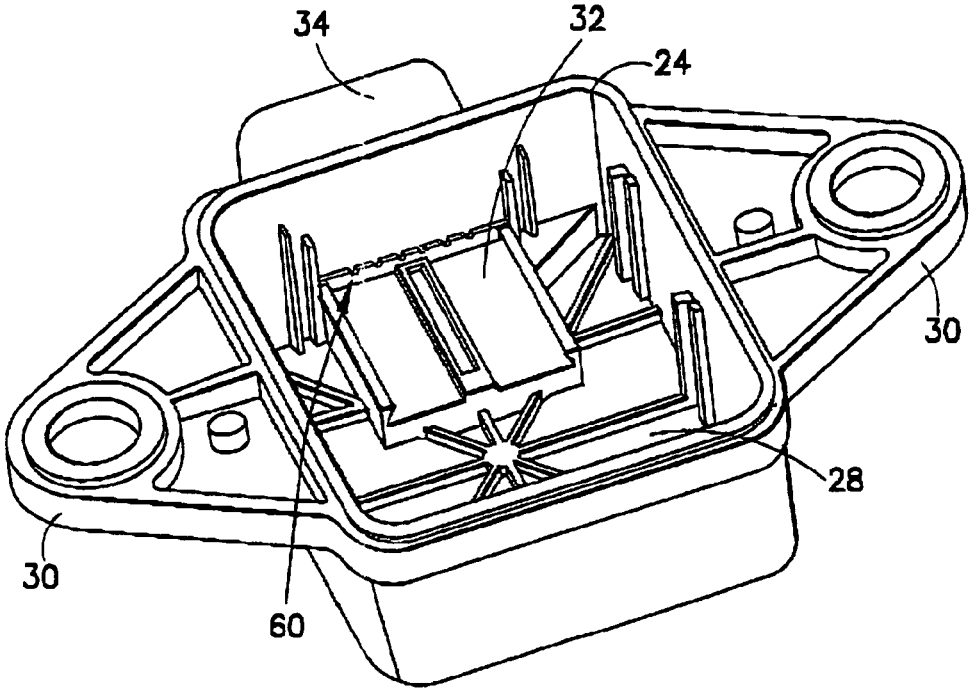
FIG. 4 is a perspective view of the housing of the assembly shown in FIG. 2.

Referring also to FIGS. 2 and 3, the housing assembly 16 generally comprises a housing 24 and an electrical connector module 26. Referring also to FIG. 4, the housing 24 preferably comprises a one-piece molded plastic or polymer member. The housing 24 comprises a main receiving area 28, mounting sections 30, a module mounting area 32, and a mating connector mounting area or shroud 34. The main receiving area 28 forms a general box shape with side walls adapted to house the electronic component(s) 18. The mounting sections 30 are adapted to receive fasteners to mount the device 10 to the member 12. The module mounting area 32 is adapted to mount the electrical connector module 26 at a fixed location on the housing 24 inside the main receiving area 28. The shroud 34 is adapted to removably receive the end of the mating electrical connector 14 therein. The mating electrical connector 14 comprises electrical contacts 36 for mating with the contact terminals of the electrical connector module 26 in the open area inside the shroud 34.

Referring also to FIGS. 5-8, the electrical connector module 26 generally comprises a carrier or frame 38 and electrical contact terminals 40. The frame 38 comprises a one-piece molded plastic or polymer member. The electrical contact terminals 40 are stitched into the frame 38. However, in an alternate embodiment the frame 38 could be overmolded onto the contact terminals 40, or any suitable method of connecting the contact terminals with the frame could be provided. The frame 38 has a general L shape with a first leg 42 and a second leg 44. The contact terminals 40 are mounted to the first leg 42. The second leg 44 forms a housing mounting section for the frame. The housing mounting section comprises angled rail sections 46 on opposite sides of the second leg 44 and a snap finger 48 at a rear end of the second leg 44.

Figure 7:
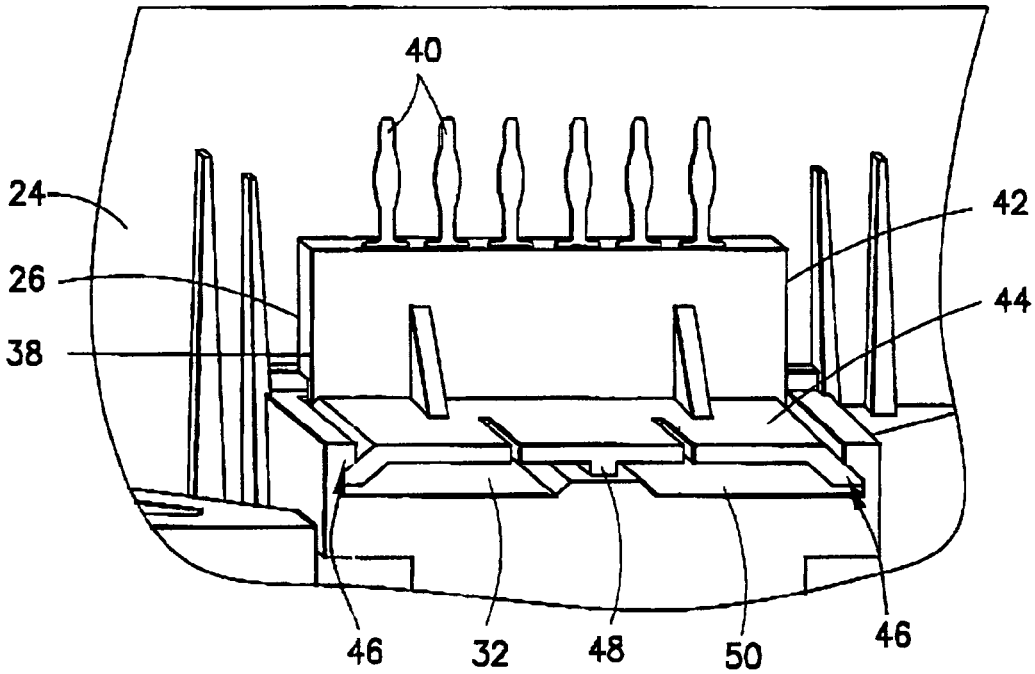
FIG. 7 is a perspective view of the module shown in FIG. 6 shown attached to the module mounting area of the housing.
Figure 8:
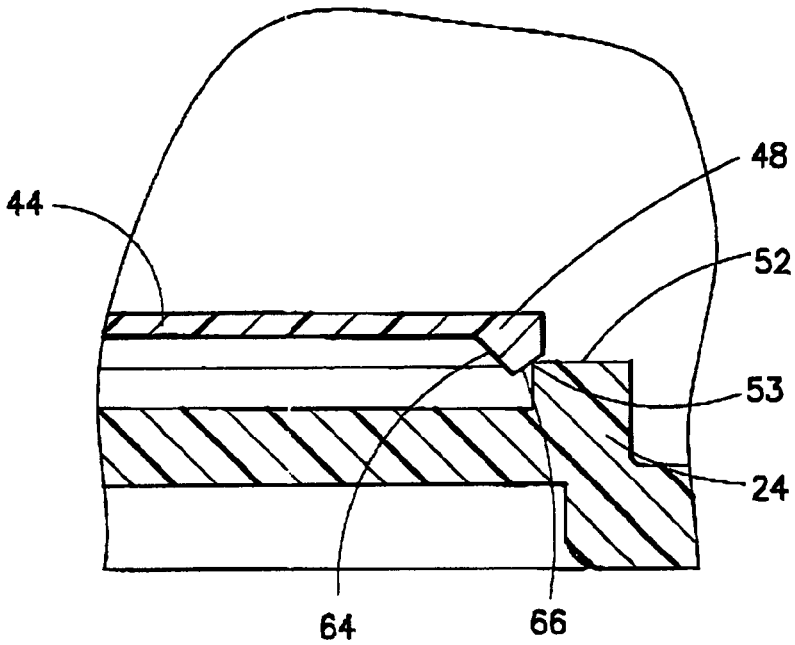
FIG. 8 is an enlarged cross sectional view of the snap finger connection of the module to the housing of Area A shown in FIG. 3.

As seen best in FIG. 7, the module mounting area 32 of the housing 24 has a general dove-tail shaped slot 50. The second leg 44 of the frame 38 is adapted to slide into the slot 50 with the ends of the angled rail sections 46 contacting ends of the slot 50 to side-to-side stationarily locate the module 26 in the module mounting area 32. As seen best in FIG. 3, the front of the frame 38 contacts the housing 24 to stop the forward location of the frame 38 in the slot 50, and the snap finger 48 contacts a portion 52 of the housing at the slot 50 to prevent rearward movement of the module 26 in the module mounting area 32 once it is installed.

Figure 5:
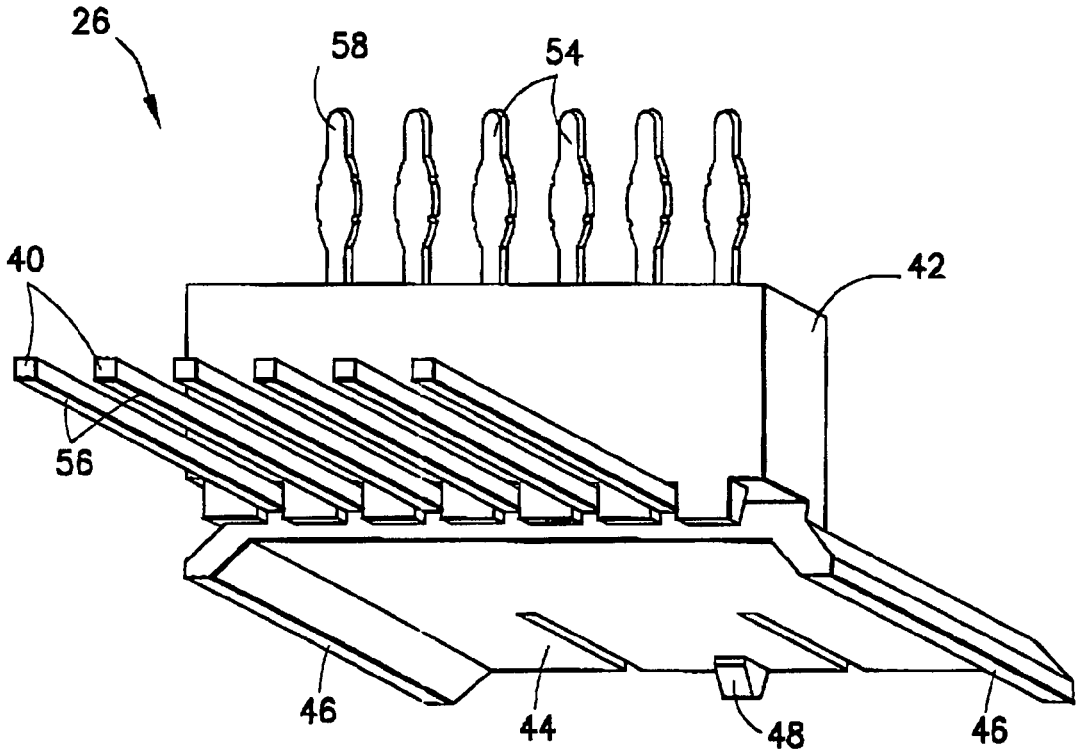
FIG. 5 is a perspective view of the electrical connector module of the assembly shown in FIG. 2.

As seen best in FIGS. 3 and 5, in this embodiment the contact terminals 40 each have a general L shape with a first leg 54 and a second leg 56. The first legs 54 are mounted in the first leg 42 of the frame 38. First ends 58 of the contact terminals extend up past the top side of the frame 38. In this embodiment the first ends 58 have press-fit shapes for making a press-fit mechanical and electrical connection in mounting holes of the PCB 20. However, the first ends of the contacts could have any suitable shape. The second legs 56 extend in a forward direction from the first leg 42 of the frame; in a direction opposite to the second leg 44 of the frame 38. The second legs 56 form male contact pins for removable connection with the female contact 36 of the mating electrical connector 14.

As seen in FIG. 4, the housing 24 has channels 60 which extend through the wall of the housing 24 from the module mounting area 32 into the open area of the shroud 34. When the module 26 is slid into the module mounting area 32, the second legs 56 of the contact terminals 40 slide through the channels 60 into the open area of the shroud.

Figure 6:
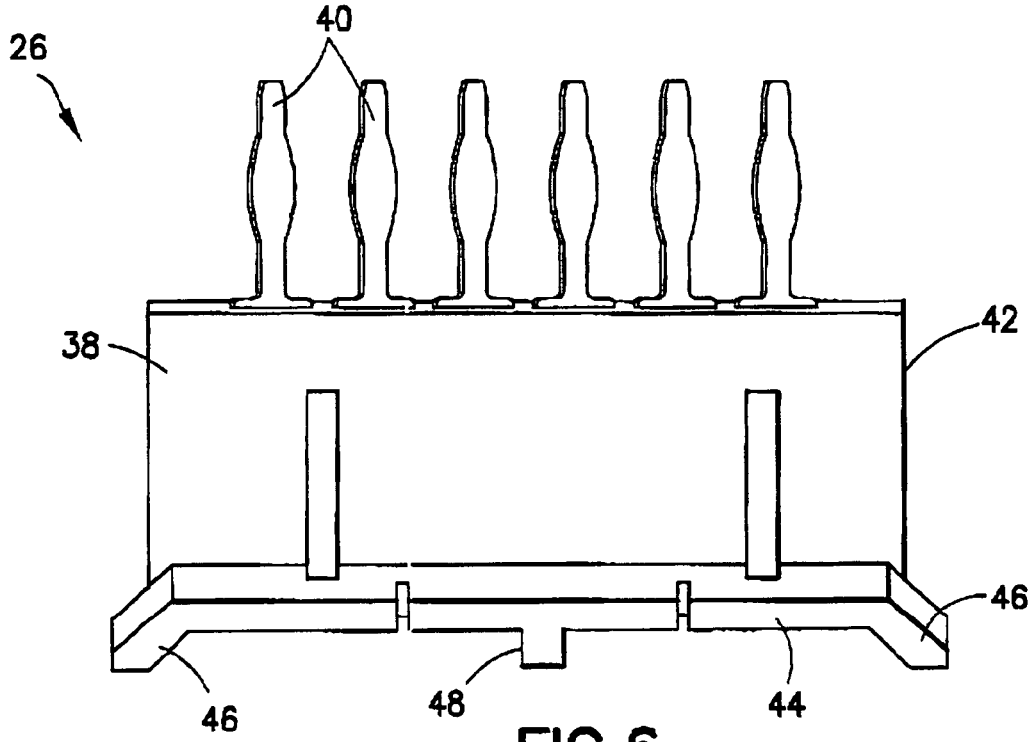
FIG. 6 is a rear end view of the module shown in FIG. 5.

As noted above, the snap finger 48 is adapted to contact a portion 52 of the housing 24 to retain the module in the module mounting area 32. As seen in FIGS. 5-7, the snap finger 48 comprises a resiliently deflectable cantilevered section of the frame 38 extending in a rearward direction. At the end of the snap finger 48 is a downward projection 62. As seen best in FIG. 8, the projection 62 has a front ramp surface 64 and a rear ramp surface 66. When the module 26 is being initially installed into the module mounting area 32, the front ramp surface 64 helps guide and deflect the projection 62 over the portion 52. When the rear ramp surface 66 comes into contact with the edge 53 of the portion 52, the rear ramp surface 66 helps to bias the frame 38 in a forward direction to firmly seat the module 26 in the front of the module mounting area against the wall of the housing 24. Thus, the snap finger is adapted to snap behind the portion 52 of the housing and exert a continuous force against the portion of the housing to bias the module 26 forward. This insures precise placement of the module 26 on the housing 24 for easier and more dependable connection of the electronic component(s) 18 to the first ends 58 of the contact terminals 40 during assembly of the device 10.

With the invention, the frame or carrier, with a given number of stitched terminals, can mate to the housing by means of a dove-tail and can be retained with a continuous force snap finger. Channels in the housing can guide and support the terminals into the shroud, and a recess in the housing locks the snap finger with continuous force. The modular carrier can be tooled and populated to suit multiple applications of different housings.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector module comprising:

a plurality of electrical contact terminals; and a frame adapted to be attached to a housing, wherein the electrical contact terminals are connected to the frame and have opposite ends which extend away from the frame in two respective different directions, wherein the frame comprises a plug section adapted to be mechanically plugged into the housing and a resiliently deflectable snap finger adapted to snap-lock behind a portion of the housing, wherein the frame comprises a general L shape with the plug section forming a second leg of the general L shape and the electrical contact terminals being mounted to a first leg of the general L shape, wherein second ones of the ends of the electrical contact terminals extend from a front end of the frame, wherein first ones of the ends of the electrical contact terminals extend from a top of the first leg of the frame, and wherein the second leg of the frame extends in a rearward direction generally opposite the second ends of the electrical contact terminals.

2. An electrical connector module as in claim 1 wherein the electrical contact terminals each comprise a general L shape.

3. An electrical connector module as in claim 1 wherein the plug section comprises angled rail sections on opposite sides of the frame.

4. An electrical connector module as in claim 1 wherein the frame comprise a single molded plastic member.

5. An electrical connector module as in claim 1 wherein the snap finger comprises two angled ramp surfaces for contacting the portion of the housing.

6. An electronic device housing assembly comprising:

a housing; and an electrical connector module mounted to the housing, wherein the electrical connector module comprises:

a plurality of electrical contact terminals; and a frame attached to the housing, wherein the electrical contact terminals are connected to the frame and have opposite ends which extend away from the frame in two respective different directions, wherein the frame comprises a plug section mechanically plugged into the housing and a resiliently deflectable snap finger snap-locked behind a portion of the housing, wherein second ones of the ends of the electrical contact terminals extend in channels through a wall of the housing into a connector shroud of the housing.

7. An electronic device housing assembly as in claim 6 wherein the housing comprises a receiving slot having a general dove-tail shape, and wherein the plug section of the frame is slidably mounted into the receiving slot.

8. An electronic device comprising:

an electronic device housing assembly as in claim 6; and an electronic component located in the housing and connected to first ones of the ends of the electrical contact terminals.

9. An electrical connector module comprising:

a plurality of electrical contact terminals; and a frame having the electrical contact terminals mounted thereto, wherein the frame comprises a housing mounting section adapted to mount the frame to a housing, wherein the housing mounting section comprises angled rail sections on opposite sides of the frame and a snap finger at a rear end of the frame, wherein the rail sections are adapted to slide into a general dove-tail receiving slot of the housing, and wherein the snap finger is adapted to snap behind a portion of the housing and exert a continuous force against the portion of the housing.

10. An electrical connector module as in claim 9 wherein the electrical contact terminals each comprise a general L shape.

11. An electrical connector module as in claim 9 wherein the frame comprise a single molded plastic member.

12. An electrical connector module as in claim 9 wherein the snap finger comprises two angled ramp surfaces for contacting the portion of the housing.

13. An electrical connector module as in claim 9 wherein the frame comprises a general L shape with the housing mounting section forming a second leg of the general L shape and the electrical contact terminals being mounted to a first leg of the general L shape.

14. An electrical connector module as in claim 13 wherein second ends of the electrical contact terminals extend from a front end of the frame, wherein first ends of the electrical contact terminals extend from a top of the first leg of the frame, and wherein the second leg of the frame extends in a rearward direction generally opposite the second ends of the electrical contact terminals.

15. An electronic device housing assembly comprising:

a housing; and an electrical connector module as in claim 11 mounted to the housing, wherein second ends of the electrical contact terminals extend in channels through a wall of the housing into a connector receiving area of the housing.

16. An electronic device housing assembly as in claim 15 wherein the housing comprises a receiving slot having a general dove-tail shape, and wherein the housing mounting section of the frame is slidably mounted into the receiving slot.

17. An electronic device comprising:

an electronic device housing assembly as in claim 15; and an electronic component located in the housing and connected to first ends of the electrical contact terminals.

18. An electrical connector module comprising:

a carrier frame adapted to be mounted to a receiving housing, wherein the carrier frame comprises a general L shaped cross section with a first leg and a second leg; and a plurality of electrical contact terminals mounted to the carrier frame, wherein the electrical contact terminals each comprise a general L shape with a first leg mounted in the first leg of the carrier frame and a second leg extending in a direction generally opposite to the second leg of the carrier frame, wherein the second leg of the carrier frame is adapted to be snapped into the receiving housing.

* * * * *